US009680218B2

(12) United States Patent
Katz et al.

(10) Patent No.: US 9,680,218 B2
(45) Date of Patent: Jun. 13, 2017

(54) METHOD AND APPARATUS FOR CONTROLLING AN ANTENNA

(75) Inventors: Marshall Joseph Katz, Palatine, IL (US); Randy Alan Wiessner, Palatine, IL (US)

(73) Assignee: BlackBerry Limited, Waterloo, Ontario (CA)

( * ) Notice: Subject to any disclaimer, the term of this patent is extended or adjusted under 35 U.S.C. 154(b) by 236 days.

(21) Appl. No.: 13/530,394

(22) Filed: Jun. 22, 2012

(65) Prior Publication Data

US 2013/0342421 A1 Dec. 26, 2013

(51) Int. Cl.

*H01Q 1/52* (2006.01)
*H01Q 7/00* (2006.01)
*H01Q 1/24* (2006.01)

(52) U.S. Cl.

CPC ..... *H01Q 1/52* (2013.01); *H01Q 1/24* (2013.01); *H01Q 7/005* (2013.01)

(58) Field of Classification Search

CPC ..... H01Q 5/00; H01Q 5/0006
USPC ..... 343/852
See application file for complete search history.

(56) References Cited

U.S. PATENT DOCUMENTS 6,657,595 B1 * 12/2003 Phillips et al. ..... 343/702
2005/0237198 A1 * 10/2005 Waldner et al. ..... 340/572.7
2005/0245204 A1 * 11/2005 Vance ..... 455/80
2006/0281423 A1 * 12/2006 Caimi ..... H01Q 9/045 455/129
2009/0096683 A1 4/2009 Rosenblatt et al.
2009/0170559 A1 * 7/2009 Phillips ..... H01Q 1/243 455/556.1
2010/0085260 A1 * 4/2010 McKinzie et al. ..... 343/703
2011/0250928 A1 10/2011 Schlub

FOREIGN PATENT DOCUMENTS

EP 1511117 A1 3/2005
WO 2011042051 A1 10/2009
WO 2012025923 A1 3/2012

OTHER PUBLICATIONS

Extended European Search report mailed Jan. 10, 2013, in corresponding European patent application No. 12173169.9.

* cited by examiner

*Primary Examiner* — Jessica Han
*Assistant Examiner* — Daniel J Munoz
(74) *Attorney, Agent, or Firm* — Fish & Richardson P.C.

(57) ABSTRACT

A method and apparatus for controlling an antenna is provided. A load on a second antenna of a device is determined, the device comprising at least one processor, a first antenna, a variable tuning circuit connected to the first antenna, and the second antenna, wherein the processor determines the load. The processor controls the variable tuning circuit based on the load on the second antenna to change a match of the first antenna.

20 Claims, 6 Drawing Sheets

METHOD AND APPARATUS FOR CONTROLLING AN ANTENNA

FIELD

The specification relates generally to antennas, and specifically to a method and apparatus for controlling an antenna.

BACKGROUND

Variable antenna tuning/matching components generally change a match to an antenna to compensate for loading effects caused by a user or objects located close to the antenna. These circuits can provide considerable gain in antenna performance but require knowledge on the current state of the environment in which the antenna is being operated; this information is not easy to measure. If the wrong operating conditions are assumed than performance can be degraded as compared to the case of doing nothing.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
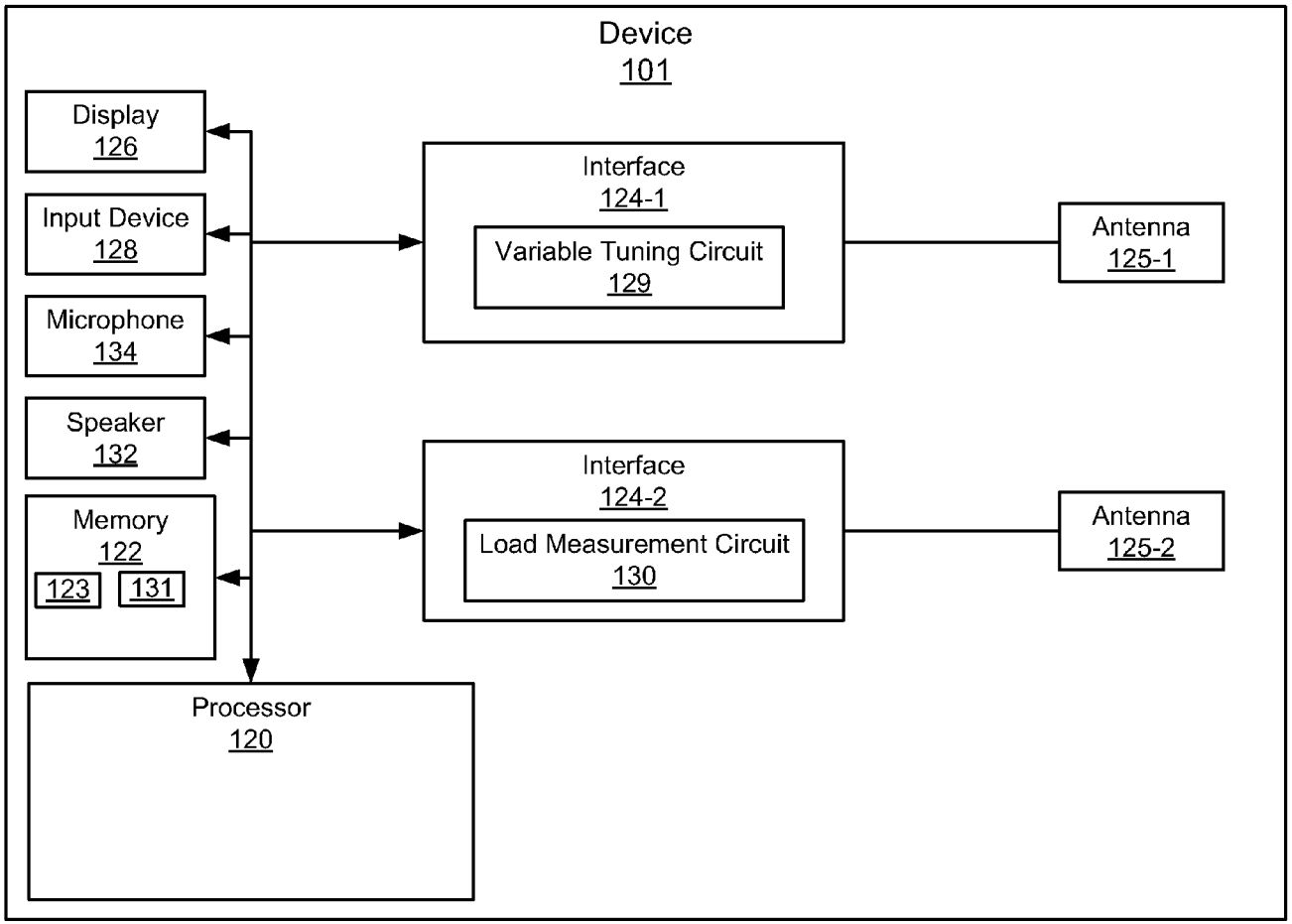
FIG. 1 depicts a schematic diagram of device for controlling an antenna, according to non-limiting implementations.

The techniques described in this specification can allow for efficient matching of an antenna of a device, leading to better receive and transmission characteristics of the antenna. The tuning is based on measuring a load on a second antenna at the device to determine an environment of the device that affects matching of the antenna. The measuring of the load on the second antenna can be conveniently performed using NFC (near field communication) chipsets.

An aspect of the specification provides a device comprising: at least one processor, a first antenna, a variable tuning circuit connected to the first antenna, and a second antenna, the at least one processor enabled to: determine a load on the second antenna; and, control the variable tuning circuit based on the load on the second antenna to change a match of the first antenna.

The first antenna can comprise a main antenna and the second antenna can comprise one or more NFC (near field communication) antennas.

The at least one processor can be further enabled to determine the load on the second antenna by measuring a resonance frequency of the second antenna.

The at least one processor can be further enabled to: sweep a frequency of a transmit signal provided to the second antenna and measure one or more of a voltage and a current of a signal from the second antenna; and, determine the load on the second antenna by determining a resonance frequency corresponding to one or more of a largest voltage and a largest current, the resonance frequency being proportional to the load.

The at least one processor can be further enabled to determine the load on the second antenna by measuring a capacitance of the second antenna.

The device can further comprise a variable capacitor and an impedance coil connected to the second antenna, and the at least one processor can be further enabled to: maintain a given resonance frequency of the impedance coil as the load on the second antenna changes by adjusting the variable capacitor accordingly; and, determine the load on the second antenna by determining a change of the variable capacitor as the variable capacitor is adjusted, the change being proportional to loading on the impedance coil.

The second antenna can comprise a plurality of antennas to determine when loading objects are located near one or more of a front of the device and a rear of the device.

The at least one processor can be further enabled to control the variable tuning circuit based on the load on the second antenna to change the match of the first antenna by processing data for controlling the variable tuning circuit, the data relating the matching to the load.

The device can further comprise a memory storing data for controlling the variable tuning circuit based on the load on the second antenna, the data relating the matching to the load.

The device can further comprise one or more proximity sensors to determine one or more of: proximity of objects to the device; and the at least one processor can be further enabled to determine the load on the second antenna when proximity of an object is detected at the one or more proximity sensors.

Another aspect of the specification provides a method comprising: determining a load on a second antenna of a device comprising at least one processor, a first antenna, a variable tuning circuit connected to the first antenna, and the second antenna, wherein the processor determines the load; and, controlling, at the processor, the variable tuning circuit based on the load on the second antenna to change a match of the first antenna.

The first antenna can comprise a main antenna and the second antenna can comprise one or more NFC (near field communication) antennas.

The method can further comprise determining the load on the second antenna by measuring a resonance frequency of the second antenna.

The method can further comprise: sweeping a frequency of a transmit signal provided to the second antenna and measuring one or more of a voltage orand current of a signal from the second antenna; and, determining the load on the second antenna by determining a resonance frequency corresponding to one or more of the a largest voltage and a largest or current, the resonance frequency being proportional to the load.

The method can further comprise determining the load on the second antenna by measuring a capacitance of the second antenna.

The device further can comprise a variable capacitor and an impedance coil connected to the second antenna, and the method can further comprise: maintaining a given resonance frequency of the impedance coil as the load on the second antenna changes by adjusting the variable capacitor accordingly; and, determining the load on the second antenna by determining a change of the variable capacitor as the variable capacitor is adjusted, the change being proportional to loading on the impedance coil.

The second antenna can comprise a plurality of antennas to determine when loading objects are located near one or more of a front of the device and a rear of the device.

The method can further comprise controlling the variable tuning circuit based on the load on the second antenna to change the match of the first antenna by processing data for controlling the variable tuning circuit, the data relating the matching to the load.

The device can further comprise one or more proximity sensors to determine one or more of: proximity of objects to the device; and the method can further comprise determining the load on the second antenna when proximity of an object is detected at the one or more proximity sensors.

Yet a further aspect of the specification provides a non-transitory computer program product, comprising a computer usable medium having a computer readable program code adapted to be executed to implement a method comprising: determining a load on a second antenna of a device comprising at least one processor, a first antenna, a variable tuning circuit connected to the first antenna, and the second antenna, wherein the processor determines the load; and, controlling, at the processor, the variable tuning circuit based on the load on the second antenna to change a match of the first antenna.

FIG. 1 depicts a schematic diagram of a device 101 for controlling an antenna, according to non-limiting implementations. Device 101 comprises a processor 120 interconnected with a memory 122, communications interfaces 124-1, 124-2, a first antenna 125-1, a second antenna 125-2, a display 126 and an input device 128, and optionally a microphone 134 and speaker 132. Communications interfaces 124-1, 124-2 will be interchangeably referred to, generically, as an interface 124, and collectively as interfaces 124. Antennas 125-1, 125-2 will be interchangeably referred to, generically, as an antenna 125, and collectively as antennas 125. Interface 124-1 further comprises a variable tuning circuit 129 for tuning antenna 125-1. Interface 124-2 further comprises a load measurement circuit 130 for measuring load on antenna 125-2. As will be presently explained, processor 120 is generally enabled to control antenna 125-1; specifically, processor 120 is enabled to: determine a load on second antenna 125-2; and, control variable tuning circuit 129 based on the load on second antenna 125-2 to change a match of first antenna 125-1. Hence, for example, when an object that affects the load of antennas 125 is proximal device 101, the load of second antenna 125-2 can be determined, using load measurement circuit 130, and used to change a match of first antenna 125-1. Hence, for example, load changes due to loading objects, including but not limited to metallic objects, can be detected using second antenna 125-2 and used to tune variable tuning circuit 129 to match first antenna 125-1.

Device 101 can be any type of electronic device that can be used in a self-contained manner to communicate with one or more communication networks using antennas 125. Device 101 includes, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations.

It should be emphasized that the structure of device 101 in FIG. 1 is purely an example, and contemplates a device that can be used for both wireless voice (e.g. telephony) and wireless data communications (e.g. email, web browsing, text, and the like). However, while FIG. 1 contemplates a device that can be used for telephony, in other implementations, device 101 can comprise a device enabled for implementing any suitable specialized functions, including but not limited to one or more of telephony, computing, appliance, and/or entertainment related functions.

Device 101 comprises at least one input device 128 generally enabled to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

In particular, it is appreciated that memory 122 stores an application 123 that, when processed by processor 120, enables processor 120 to: determine a load on second antenna 125-2; and, control variable tuning circuit 129 based on the load on second antenna 125-2 to change a match of first antenna 125-1.

Memory 122 can further store data 131 for controlling variable tuning circuit 129 based on the load on second antenna 125-2, data 131 associating the load on second antenna 125-2 to matching of first antenna 125-1 to radio equipment at interface 124-1, as will be described below. Data can be in any suitable format, including, but not limited to a look-up table, a database and the like. In general, data 131 comprises an association between data indicative of a load on second antenna 125-2 and one or more of matching impedance data for first antenna 125-1 and data for controlling variable tuning circuit 129. In other words, there is an underlying assumption in data 131 that the load on first antenna 125-1 is related to the determined load on second antenna 125-2, such that the determined load on second antenna 125-2 can be used to control variable tuning circuit 129.

Processor 120 can be further configured to communicate with display 126, and optionally microphone 134 and speaker 132. Display 126 comprises any suitable one of, or combination of, CRT (cathode ray tube) and/or flat panel displays (e.g. LCD (liquid crystal display), plasma, OLED (organic light emitting diode), capacitive or resistive touch-screens, and the like). Microphone 134, when present, comprises any suitable microphone for receiving sound data. Speaker 132, when present, comprises any suitable speaker for providing sound data, audible alerts, audible communications from remote communication devices, and the like, at device 101.

In some implementations, input device 128 and display 126 are external to device 101, with processor 120 in communication with each of input device 128 and display 126 via a suitable connection and/or link.

Processor 120 also connects to interfaces 124, each of which can be implemented as one or more radios and/or connectors and/or network adaptors, configured to wirelessly communicate with one or more communication networks (not depicted) via antennas 125. It will be appreciated that each interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+, UMTS (Universal Mobile Telecommunications System), CDMA (Code division multiple access), WCDMA (Wideband CDMA), FDD (frequency division duplexing), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WiFi links, WiMax links, packet based links, the Internet, analog networks, the PSTN (public switched telephone network), access points, and the like, and/or a combination.

Specifically, each of interfaces 124 comprises radio equipment (i.e. a radio transmitter and/or radio receiver) for receiving and transmitting signals using respective antennas 125.

It is further appreciated that variable tuning circuit 129 can comprise any suitable circuit for tuning antenna 125-1 at interface 124-1, for example by matching impedance of antenna 125-1 to the radio equipment. Variable tuning circuit 129 can hence comprise any suitable combination of capacitors and impedance coils (also referred to as an inductor) for matching impedance of antenna 125-1 to the radio equipment of interface 124-1 when the loading on antenna 125-1 changes, for example when loading objects (e.g. metallic objects) are proximal device 101. Further, variable tuning circuit 129 can be controlled by processor 120.

Similarly, load measurement circuit 130 can comprise any suitable circuit for measuring a load on antenna 125-2, and can hence comprise any suitable combination of signal transmitter, signal receiver, capacitors and impedance coils for measuring a load on antenna 125-2. It is further appreciated that load measurement circuit 130 is enabled to generate and measure a signal. Specific non-limiting implementations of load measurement circuit 130 are described below with reference to load measurement circuits 130*a*, 130*b* of FIGS. 4 and 5, respectively.

In specific non-limiting implementations, device 101 can comprise a phone device, first antenna 125-1 can comprise a main antenna, for example for communicating with a cell phone network, and second antenna 125-2 can comprise an NFC antenna and/or an NFC coil. Further, it is appreciated that NFC chipsets used in phone devices have the capability to measure the loading on the NFC antenna due to hands, keys and NFC devices. They have this capability to save power as they will transmit only when the NFC antenna is loaded past a certain threshold value as other nearby NFC devices load the NFC antenna: in other words, there is no point in transmitting signals using the NFC antenna unless the NFC antennas is loaded due to the nature of NFC devices. The NFC chipsets can hence detect loading by either measuring the resonance frequency of the NFC antenna and/or the capacitance of the NFC antenna, both of which change due to objects placed near the NFC antenna. Hence, in these implementations, the load measurement circuit 130 comprises one or more NFC chipsets.

It is yet further appreciated that second antenna 125-2 can be at any suitable location in device 101, for example proximal first antenna 125-1, at a front of device 101, at a rear of device 101 and at a side of device 101. Further device 101 can comprise a plurality of antennas, similar to antenna 125-2, and a plurality of respective load measuring circuits, similar to load measuring circuit 130, to determine when loading objects are located proximal one or more of a front of the device and a rear of the device.

It is yet further appreciated that device 101 comprises a power source, not depicted, for example a battery or the like. In some implementations the power source can comprise a connection to a mains power supply and a power adaptor (e.g. and AC-to-DC (alternating current to direct current) adaptor).

In any event, it should be understood that a wide variety of configurations for device 101 are contemplated.

Figure 2:
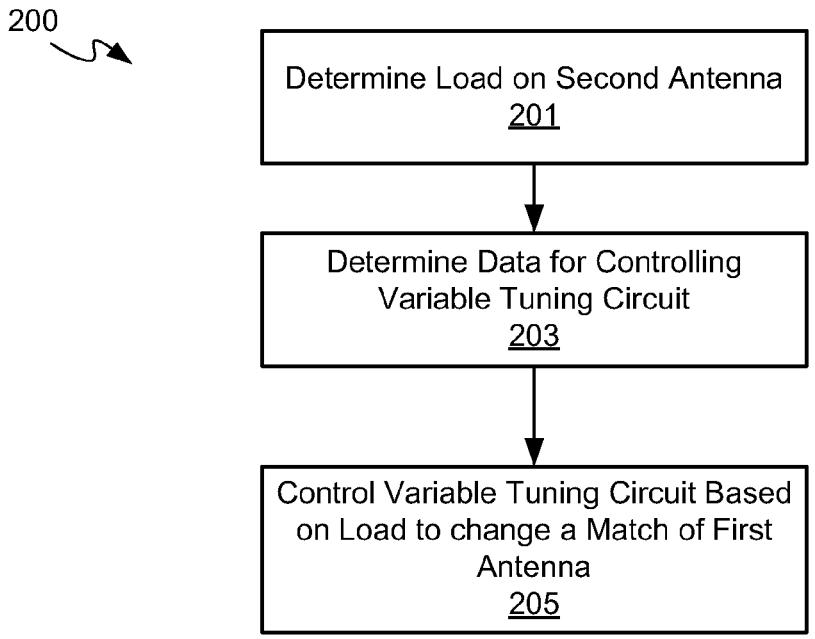
FIG. 2 depicts a flowchart of a method for controlling an antenna, according to non-limiting implementations.

Hence attention is now directed to FIG. 2 which depicts a flowchart of a method 200 for controlling an antenna, according to non-limiting implementations. In order to assist in the explanation of method 200, it will be assumed that method 200 is performed using device 101 to control antennas 125 by controlling variable tuning circuit 129. Furthermore, the following discussion of method 200 will lead to a further understanding of device 101 and its various components. However, it is to be understood that device 101 and/or method 200 can be varied, and need not work exactly as discussed herein in conjunction with each other, and that such variations are within the scope of present implementations.

It is appreciated that, in some implementations, method 200 is implemented in device 101 by a processor 120 processing application 123. It is further appreciated that aspects of method 200 can be implemented by one or more processors at interfaces 124, for example chipsets at interfaces 124. Indeed, method 200 is one way in which device 101 can be configured. It is to be emphasized, however, that method 200 need not be performed in the exact sequence as shown, unless otherwise indicated; and likewise various blocks may be performed in parallel rather than in sequence; hence the elements of method 200 are referred to herein as "blocks" rather than "steps". It is also to be understood, however, that method 200 can be implemented on variations of device 101 as well.

Figure 3:
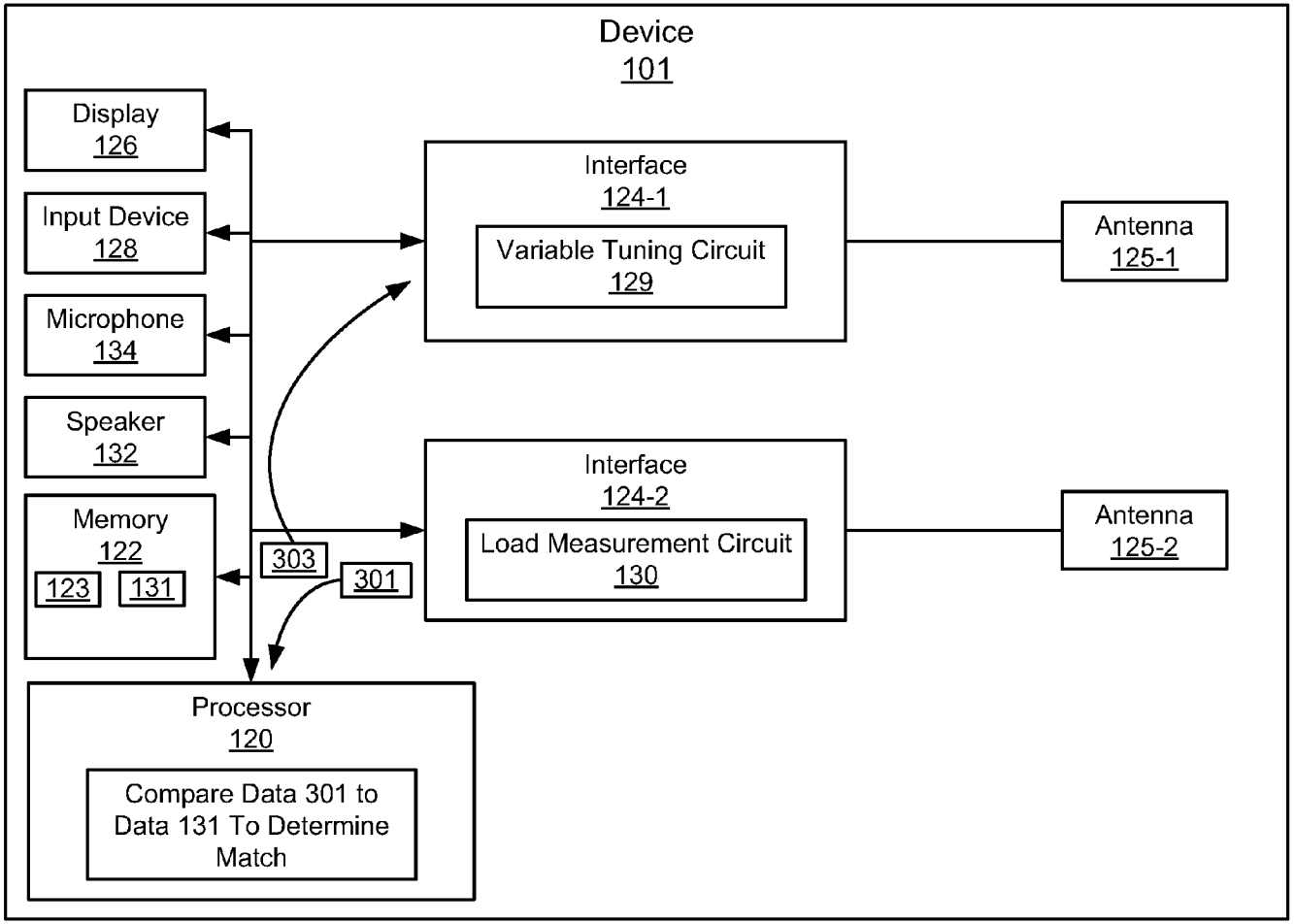
FIG. 3 depicts the device of FIG. 1 showing a loading of a second antenna being determined and a variable tuning circuit of a first antenna being tuned in response, according to non-limiting implementations.

Further, the following discussion of method 200 will be done with reference to FIG. 3, which is similar to FIG. 1, with like elements having like numbers.

At block 201, processor 120 determines a load on second antenna 125-2. Specifically, data 301 is returned to processor 120 from load measurement circuit 130, data 301 indicative of load on antenna 125-2.

Load on antenna 125-2 can be determined in any suitable manner, including, but not limited to one or more of the following techniques:

1. Measuring a resonance frequency of second antenna 125-2. The measurement of resonance frequency can be performed by one or more of processor 120 controlling load measuring circuit 130 and by processor 120 communicating with a processor and/or chipset at load measuring circuit 130 that performs the measurement and communicates the measured resonance frequency and/or a measured load to processor 120. For example, in these implementations, load measuring circuit 130 is generally enabled to sweep a frequency of a transmit signal provided to second antenna 125-2, for example by interface 124-2 and/or load measuring circuit 130, and measure one or more of a voltage and a current of a signal from second antenna 125-2; and, determine the load on second antenna 125-2 by determining a resonance frequency corresponding to one or more of a largest voltage and a largest current, the resonance frequency being proportional to the load.

Figure 4:
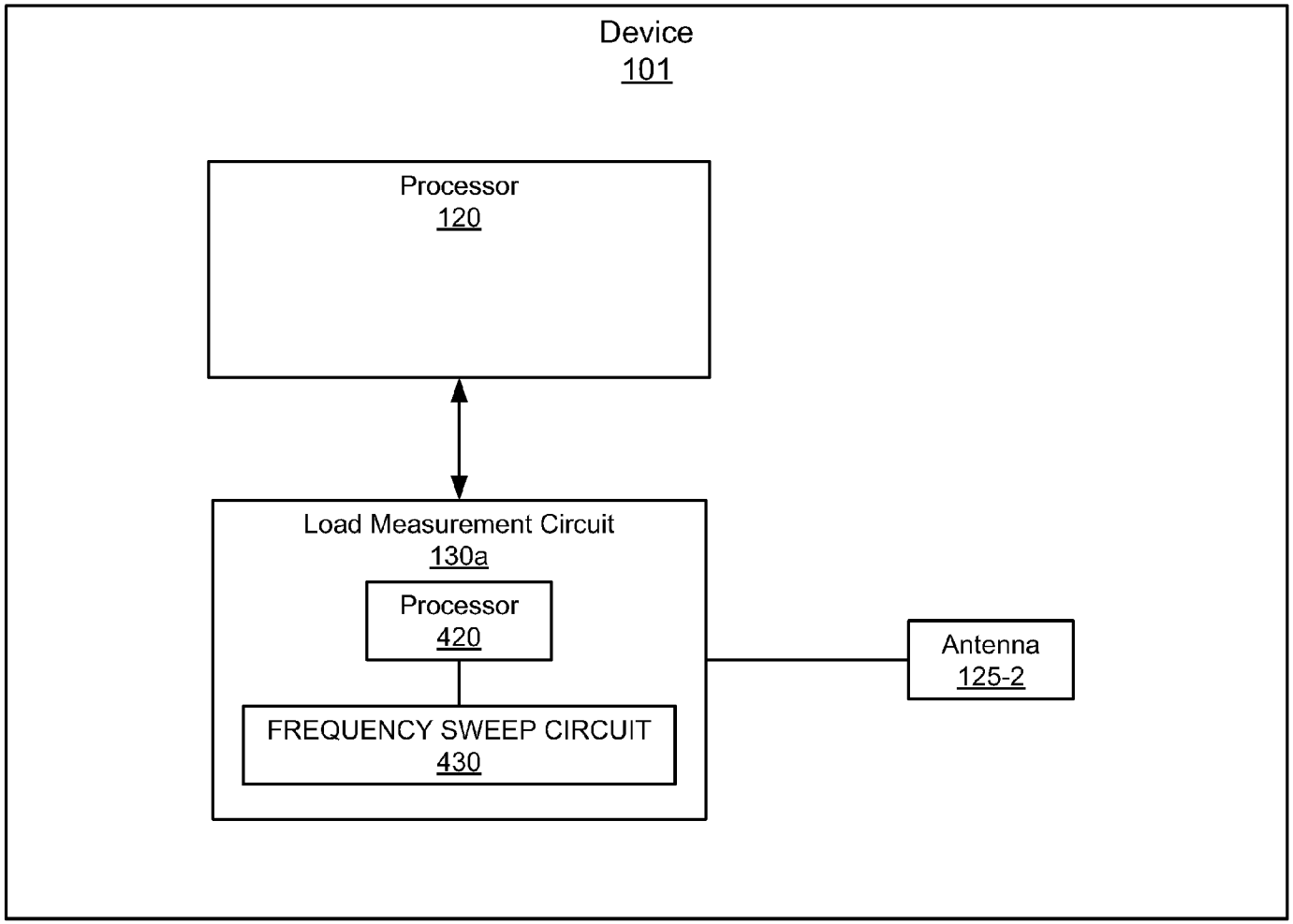
FIG. 4 depicts components of the device of FIG. 1 including a specific non-limiting implementation of a load measurement circuit at the second antenna.

An example of such a load measuring circuit 130*a* is depicted in FIG. 4, which depicts a portion of components of device 101: processor 120 is in communication with load measuring circuit 130*a* which in turn measures load on second antenna 125-2. Load measuring circuit 130*a* comprises a processor 420 which controls a frequency sweep circuit 430 for sweeping a frequency of a transmit signal provide to second antenna 430. Processor 420 can include, but is not limited to, an NFC chipset. The load measurement hence results in a determination of a resonance frequency. The measured resonance frequency can be converted to load impedance or the measured resonance frequency can be used as an indication of load, with data 131 comprising an association between resonance frequencies and data for controlling variable tuning circuit 129. When the measured resonance frequency is converted to load impedance, the conversion can occur at one or more of processor 120 and processor 420. In any event, it is appreciated that, in these implementations, load measurement circuit 130 comprises load measurement circuit 130*a* of FIG. 4.

2. Measuring a capacitance of second antenna 125-2. For example, in these implementations, load measuring circuit 130 generally comprises a variable capacitor and an impedance coil, and load measuring circuit 130 is generally enabled to maintain a given resonance frequency of the impedance coil by adjusting the variable capacitor; the load on second antenna 125-2 is determined by determining the change in capacitance of the variable capacitor, the change in capacitance generally appreciated to be proportional to loading on the impedance coil, and hence to loading on second antenna 125-2.

Figure 5:
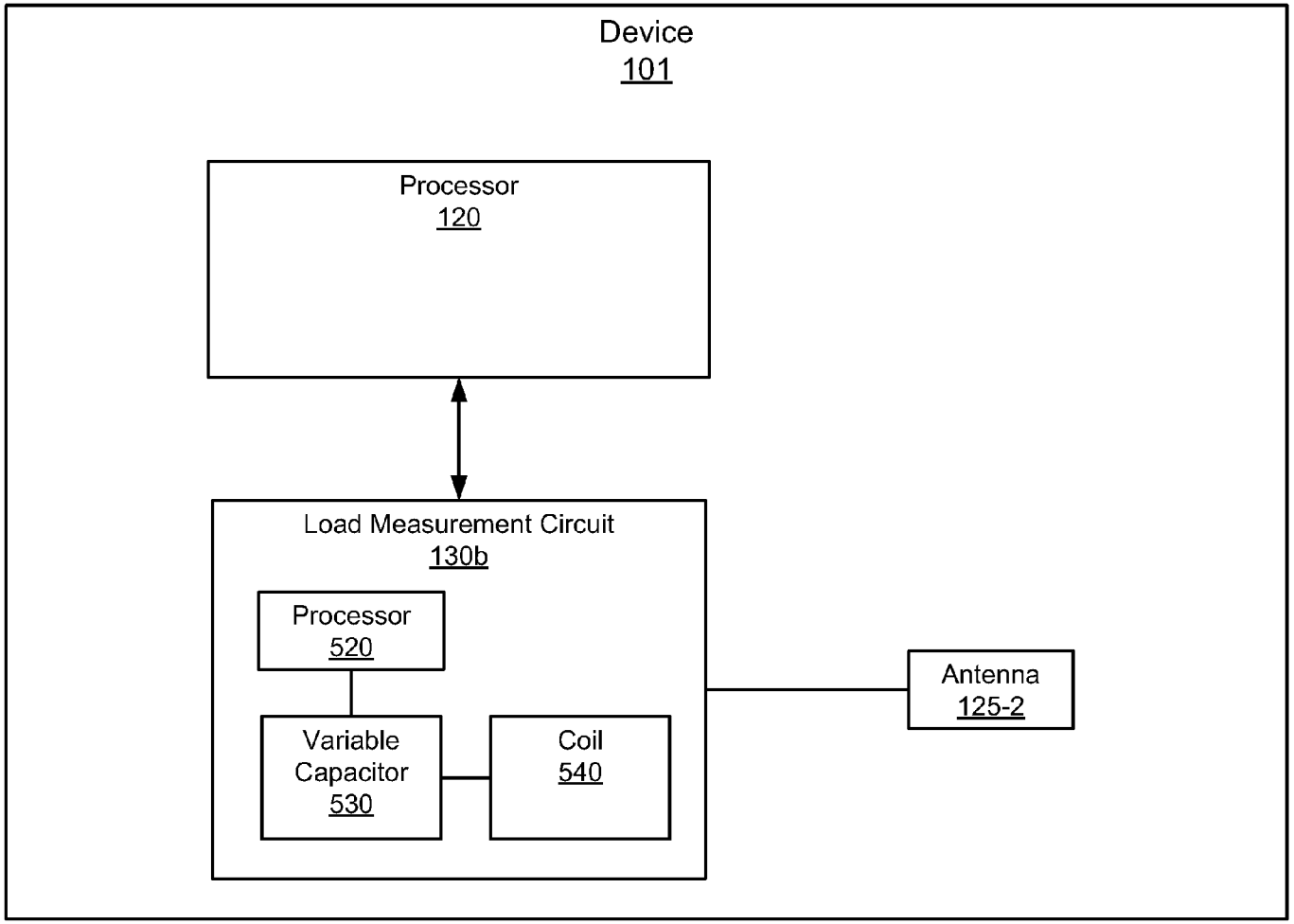
FIG. 5 depicts components of the device of FIG. 1 including a specific non-limiting implementation of a load measurement circuit at the second antenna.

An example of such a load measuring circuit 130*b* is depicted in FIG. 5, which depicts a portion of components of device 101: processor 120 is in communication with load measuring circuit 130*b* which in turn measures load on second antenna 125-2. Load measuring circuit 130*b* comprises a processor 520 which controls a variable capacitor 530 to maintain a given resonance frequency on an impedance coil 540 connected to second antenna 125-2. Processor 520 can include, but is not limited to, an NFC chipset. The resonance frequency can be predetermined and can comprise, for example a resonance frequency of antenna 125-2 when no loading objects are proximal antenna 125-2. The load measurement hence results in a determination of a change in capacitance of variable capacitor 530. The change in capacitance can be converted to load impedance or the change in capacitance can be used as an indication of load, with data 131 comprising an association between capacitance (and/or capacitance changes) and data for controlling variable tuning circuit 129. When the change in capacitance is converted to load impedance, the conversion can occur at one or more of processor 120 and processor 520. In any event, it is appreciated that, in these implementations, load measurement circuit 130 comprises load measurement circuit 130*b* of FIG. 5.

Returning to FIGS. 2 and 3, at block 201, processor 120 receives data 301 from load measurement circuit 130 to determine the load on second antenna 125-2. Processor 120 optionally converts resonance frequency data, capacitance data therein to load impedance data.

In any event, at block 203, processor compares data 301 (and optionally converted data) to data 131 to determine a match for first antenna 125-1, and specifically data for for controlling variable tuning circuit 129 to match first antenna 125-1 to radio equipment at interface 124-1. The data for controlling variable tuning circuit 129 can be retrieved from data 131 using data 301 and/or can be derived by using data 301 to retrieve a matching impedance for first antenna 125-1 from data 131 and processing the matching impedance to determine the data to control variable tuning circuit 129.

In any event, at block 205, processor 120 controls variable tuning circuit 129 based on the load determined at block 201 to change a match of first antenna 125-1. For example, in depicted implementations, processor 120 transmits control data 303 to interface 124-1, which is used to control variable tuning circuit 129 to match first antenna 125-1 with radio equipment at interface 124-1.

It is further appreciated that method 200 can be implemented at any suitable time and with any suitable periodicity. For example, it is appreciated that in implementations where second antenna 125-2 comprises an NFC antenna, the associated NFC chipset (e.g. processor 420, 520) is monitoring second NFC antenna 125-2 for changes in load as part of a normal function of an NFC chipset. In these implementations, processor 120 can be implementing method 200 in the background such that block 201 is implemented repeatedly, and blocks 203, 205 occur when load changes are determined at block 201.

In other implementations, method 200 and/or block 201 is implemented periodically, for example every few seconds or the like.

Figure 6:
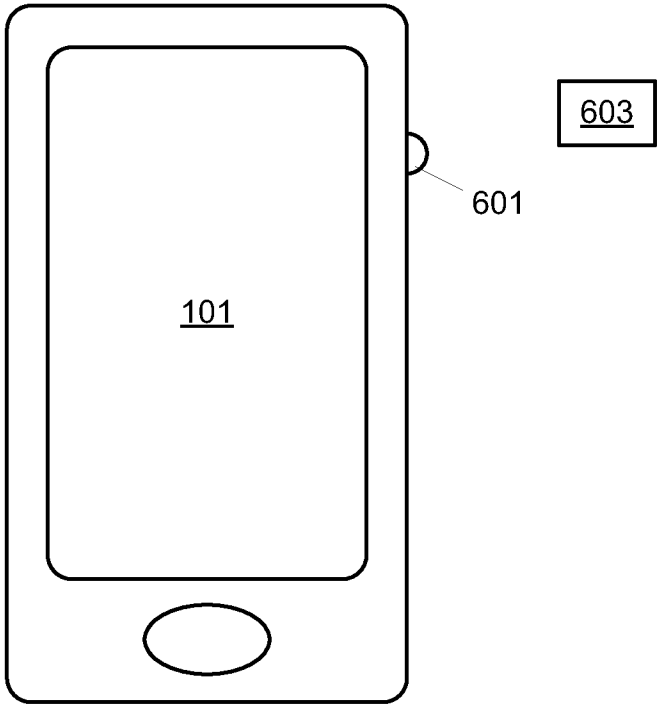
FIG. 6 depicts an alternate device for controlling an antenna that includes one or more proximity sensors, according to non-limiting implementations.

In yet further implementations, device 101 further comprises one or more proximity sensors and method 200 is implemented only when proximity of an object is detected using the one or more proximity sensors. For example, attention is directed to FIG. 6, which depicts a device 101*a* similar to device 101 but comprising a proximity sensor 601. While FIG. 6 is a perspective view of device 101*a*, it is appreciated that device 101*a* has a schematic structure similar to that of device 101 as depicted in FIG. 1, with a processor of device 101*a* implementing method 200 only when proximity sensor 601 determines that an object 603 is proximal device 101*a*. The proximity sensor 601 can comprise any suitable proximity sensor, including, but not limited to, IR (infrared) diode/detectors, capacitive sensors, capacitive displacement sensors, Doppler effect sensors, eddy-current sensor, inductive sensors, laser sensors, optical sensors, acoustic sensors, magnetic sensors, passive optical sensors (such as charge-coupled devices), passive thermal infrared sensors, photocell sensors (reflective), and the like.

A non-limiting example scenario of use of method 200 is now described. In this scenario, a main antenna can be located on a front-top of a device that is highly affected by objects placed near an audio receiver. Near the audio receiver an IR diode/detector can determine whether an object is in front of the device, and near the main antenna but it cannot determine whether it is a metallic object or a non metallic object such as wood or skin. Metallic and non-metallic objects have different effects on antenna tuning and the device may make the wrong guess in changing a variable antenna match that could result in lower performance. In any event, when the IR sensor detects an object, the device implements method 200 and one or more NFC coils/antennas located in the front of the device in locations such as behind a display, around the display or around the receiver can be probed to determine a resonance frequency. Metallic objects have a great affect on the resonance frequency of an NFC antenna while organic objects do not. Combining the proximity sensor data with the NFC coil data the phone can determine whether there is no object (i.e. no object sensed by the IR sensor), an organic object (i.e. an object is sensed by the IR sensor but no change in load is determined at the NFC antenna) or metallic object located in front of the device (i.e. an object is sensed by the IR sensor and a change in load is determined at the NFC antenna). In some implementations, a size of the metallic object and/or distance between the device and the metallic object can be estimated depending on how large a determined frequency shift, for example, is for the NFC antenna. Using this information the device can then tune the main antenna to compensate for the object in front of the device. It is, however, appreciated, that NFC antennas can be placed in other strategic locations to help detect loading for antennas in different sections of the phone.

Hence, convenient devices and methods for controlling an antenna are described herein that better enable matching of antennas to radio equipment. Further, these methods can be cheaply and conveniently implemented using a combination of a main processor of a device and existing NFC chipsets.

Those skilled in the art will appreciate that in some implementations, the functionality of devices 101, 101*a* can be implemented using pre-programmed hardware or firmware elements (e.g., application specific integrated circuits (ASICs), electrically erasable programmable read-only memories (EEPROMs), etc.), or other related components. In other implementations, the functionality of devices 101, 101*a* can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A device comprising:

at least one processor, an audio receiver, a main antenna located at a front-top of the device, reception at the main antenna affected by objects placed near the audio receiver, the main antenna configured for communication with a cell phone network, a variable tuning circuit connected to the main antenna, an NFC (Near Field Communication) antenna located at one or more of a front of the device and a back of the device, and one or more proximity sensors configured to determine whether objects are in front of the device near the audio receiver, the one or more proximity sensors located both near the audio receiver and near the main antenna, the one or more proximity sensors different from the NFC antenna, the at least one processor configured to:

only when an object is detected at the one or more proximity sensors:

determine a load on the NFC antenna by sweeping a frequency of a transmit signal of the NFC antenna; and, control the variable tuning circuit based on the load on the NFC antenna to change a match of the main antenna.

2. The device of claim 1, wherein the at least one processor is further configured to determine the load on the NFC antenna by measuring a resonance frequency of the NFC antenna.

3. The device of claim 1, wherein the at least one processor is further configured to:

sweep the frequency of the transmit signal provided to the NFC antenna and measure one or more of a voltage and current of a signal from the NFC antenna; and, determine the load on the NFC antenna by determining a resonance frequency corresponding to one or more of a largest voltage and a largest current, the resonance frequency being proportional to the load.

4. The device of claim 1, wherein the at least one processor is further configured to determine the load on the NFC antenna by measuring a capacitance of the NFC antenna.

5. The device of claim 1, further comprising a variable capacitor and an impedance coil connected to the NFC antenna, wherein the at least one processor is further configured to:

maintain a given resonance frequency of the impedance coil as the load on the NFC antenna changes by adjusting the variable capacitor accordingly; and, determine the load on the NFC antenna by determining a change of the variable capacitor as the variable capacitor is adjusted, the change being proportional to loading on the impedance coil.

6. The device of claim 1, wherein the NFC antenna comprises a plurality of NFC antennas to determine when loading objects are located near one or more of a front of the device and a rear of the device.

7. The device of claim 1, wherein the at least one processor is further configured to control the variable tuning circuit based on the load on the NFC antenna to change the match of the main antenna by processing data for controlling the variable tuning circuit, the data relating the matching to the load.

8. The device of claim 1, further comprising a memory storing data for controlling the variable tuning circuit based on the load on the NFC antenna, the data relating the matching to the load.

9. The device of claim 1, wherein the NFC antenna is located around the audio receiver.

10. The device of claim 1, further comprising a display, and the NFC antenna is located at one of behind the display or around the display.

11. A method comprising:

at a device comprising: at least one processor, an audio receiver, a main antenna located at a front-top of the device, reception at the main antenna affected by objects placed near the audio receiver, the main antenna configured for communication with a cell phone network, a variable tuning circuit connected to the main antenna, an NFC (Near Field Communication) antenna proximal the main antenna located at one or more of a front of the device and a back of the device, and one or more proximity sensors configured to determine proximity of whether objects are in front of the device near the audio receiver, the one or more proximity sensors located both near the audio receiver and near the main antenna, the one or more proximity sensors different from the NFC antenna, only when an object is detected at the one or more proximity sensors:

determining, at the least one processor, a load on the NFC antenna by sweeping a frequency of a transmit signal of the NFC antenna; and, controlling, at the at least one processor, the variable tuning circuit based on the load on the NFC antenna to change a match of the main antenna.

12. The method of claim 11, further comprising determining the load on the NFC antenna by measuring a resonance frequency of the NFC antenna.

13. The method of claim 11, further comprising:

sweeping the frequency of the transmit signal provided to the NFC antenna and measuring one or more of a voltage and current of a signal from the NFC antenna; and, determining the load on the NFC antenna by determining a resonance frequency corresponding to one or more of a largest voltage and a largest current, the resonance frequency being proportional to the load.

14. The method of claim 11, further comprising determining the load on the NFC antenna by measuring a capacitance of the NFC antenna.

15. The method of claim 11, wherein the device further comprises a variable capacitor and an impedance coil connected to the NFC antenna, the method further comprising:

maintaining a given resonance frequency of the impedance coil as the load on the NFC antenna changes by adjusting the variable capacitor accordingly; and, determining the load on the NFC antenna by determining a change of the variable capacitor as the variable capacitor is adjusted, the change being proportional to loading on the impedance coil.

16. The method of claim 11, wherein the NFC antenna comprises a plurality of NFC antennas to determine when loading objects are located near one or more of a front of the device and a rear of the device.

17. The method of claim 11, further comprising controlling the variable tuning circuit based on the load on the NFC antenna to change the match of the main antenna by processing data for controlling the variable tuning circuit, the data relating the matching to the load.

18. The method of claim 11, wherein the NFC antenna is located around the audio receiver.

19. A non-transitory computer program product, comprising a computer usable medium having a computer readable program code adapted to be executed to implement a method comprising:

at a device comprising: at least one processor, an audio receiver, a main antenna located at a front-top of the device, reception at the main antenna affected by objects placed near the audio receiver, the main antenna configured for communication with a cell phone network, a variable tuning circuit connected to the main antenna, an NFC (Near Field Communication) antenna proximal the main antenna located at one or more of a front of the device and a back of the device, and one or more proximity sensors configured to determine proximity of whether objects are in front of the device near the audio receiver, the one or more proximity sensors located both near the audio receiver and near the main antenna, the one or more proximity sensors different from the NFC antenna, only when an object is detected at the one or more proximity sensors:

determining, at the least one processor, a load on the NFC antenna by sweeping a frequency of a transmit signal of the NFC antenna; and, controlling, at the at least one processor, the variable tuning circuit based on the load on the NFC antenna to change a match of the main antenna.

20. The non-transitory computer program product of claim 19, wherein the NFC antenna is located around the audio receiver.

* * * * *